US012606967B2

(12) United States Patent
Acuff

(10) Patent No.: US 12,606,967 B2
(45) Date of Patent: Apr. 21, 2026

(54) ADJUSTABLE CONCRETE FORMS

(71) Applicant: Michael Acuff, Salem, OR (US)

(72) Inventor: Michael Acuff, Salem, OR (US)

(73) Assignee: K & E Excavating, Inc., Salem, OR (US)

( * ) Notice: Subject to any disclaimer, the term of this patent is extended or adjusted under 35 U.S.C. 154(b) by 0 days.

(21) Appl. No.: 19/293,803

(22) Filed: Aug. 7, 2025

(65) Prior Publication Data

US 2025/0361685 A1 Nov. 27, 2025

(51) Int. Cl.
*E01C 19/50* (2006.01)

(52) U.S. Cl.
CPC ..... *E01C 19/502* (2013.01)

(58) Field of Classification Search
CPC .... E01C 19/502; E01C 19/508; E01C 11/222; E04G 17/14; E04G 9/08; E04G 9/083; E04G 11/54; E04G 11/56; E04G 2017/008; E04G 25/04; E04G 25/061; B28B 7/22; B28B 7/225
See application file for complete search history.

(56) References Cited

U.S. PATENT DOCUMENTS 1,202,269 A * 10/1916 Cramer ..... E01C 19/506 249/4
2,846,749 A * 8/1958 Yates ..... E01C 19/502 249/7
3,154,832 A * 11/1964 Weidner ..... E04G 17/14 249/20
3,539,146 A * 11/1970 Smith ..... B28B 7/168 425/442
4,121,804 A * 10/1978 O'Leary ..... B28B 7/02 249/165
4,321,024 A * 3/1982 Terraillon ..... E04G 21/10 249/117
4,569,500 A * 2/1986 Beede ..... B28B 7/225 249/185
4,712,764 A * 12/1987 White ..... E01C 19/502 249/7
4,750,703 A * 6/1988 Gentilcore ..... E01C 19/502 249/4
5,039,058 A * 8/1991 Boeshart ..... E04G 17/001 16/225

(Continued)

*Primary Examiner* — Kyle J. Walraed-Sullivan
(74) *Attorney, Agent, or Firm* — Mohr Intellectual Property Law Solutions, PC

(57) ABSTRACT

Adjustable concrete forms including a landing form and a ramp form. The landing form includes jacks and landing brace members. The jacks are height adjustable. The landing brace members are supported by the jacks at a selected height. The landing brace members define a landing formwork configured to contain poured concrete in a desired landing shape. The ramp form defines a ramp formwork and is pivotally coupled to the landing form. The ramp form includes ramp brace members and couplers. The ramp brace members pivotally couple to the landing brace members and extend from the landing brace members towards a ramp start boundary. The couplers couple to the ramp brace members proximate the ramp start boundary and selectively couple to a structure proximate the ramp start boundary. The slope of the landing formwork and the slope of the ramp formwork are adjustable by selectively adjusting the height of the jacks.

17 Claims, 9 Drawing Sheets

(56) References Cited

U.S. PATENT DOCUMENTS 5,154,837 A * 10/1992 Jones ..... E04G 9/08 249/7
5,277,573 A * 1/1994 Sullivan ..... B28B 13/067 249/188
5,332,191 A * 7/1994 Nolan ..... B28B 7/02 249/4
5,655,336 A * 8/1997 Azar ..... E04G 9/06 249/19
6,021,994 A * 2/2000 Shartzer, Jr. ..... E04G 13/00 249/7
6,629,681 B1 * 10/2003 Miller ..... E04G 17/04 249/7
6,939,078 B1 * 9/2005 Anderson ..... E01C 5/003 404/75
9,731,433 B1 * 8/2017 Shumaker ..... B28B 7/0029
12,442,142 B2 * 10/2025 Norton ..... E01C 9/04
2001/0022054 A1 * 9/2001 Crant ..... E04F 11/116 52/569
2002/0179811 A1 * 12/2002 Janesky ..... E04G 9/05 249/189
2003/0042393 A1 * 3/2003 Osborn ..... E04G 17/14 249/13
2003/0111585 A1 * 6/2003 Hufnagel ..... E01C 19/502 249/1
2003/0146365 A1 * 8/2003 Miller ..... E04G 17/04 249/2
2004/0094689 A1 * 5/2004 Rose ..... E04G 17/001 249/194
2004/0161297 A1 * 8/2004 Kochling ..... E01C 11/222 404/7
2006/0260263 A1 * 11/2006 Cannata ..... E04G 13/062 52/846
2008/0292396 A1 * 11/2008 Shanley ..... E01C 11/222 404/75
2010/0071141 A1 * 3/2010 Reiner ..... E04G 11/56 52/848
2010/0327145 A1 * 12/2010 Savard ..... B29C 33/48 264/219
2014/0015154 A1 * 1/2014 Hogan ..... E04G 13/068 249/13
2014/0166848 A1 * 6/2014 Hunt ..... E04G 13/00 249/1
2015/0136943 A1 * 5/2015 Parr ..... B28B 7/0079 249/191
2015/0252576 A1 * 9/2015 Parr ..... E01C 19/508 249/191
2017/0089081 A1 * 3/2017 Byfield ..... E04G 17/0652
2018/0010347 A1 * 1/2018 Dingler ..... E04G 17/001
2018/0258655 A1 * 9/2018 Reitano ..... E04G 17/14
2019/0032347 A1 * 1/2019 Young ..... E04G 13/00
2019/0292798 A1 * 9/2019 Warren ..... E04G 17/14
2020/0080326 A1 * 3/2020 White ..... E04G 17/04
2025/0012103 A1 * 1/2025 Baggaley ..... E04G 21/10
2025/0034888 A1 * 1/2025 Baggaley ..... E04F 21/241

* cited by examiner

ADJUSTABLE CONCRETE FORMS

BACKGROUND

The present disclosure relates generally to concrete forms. In particular, adjustable concrete forms are described.

Ramps designed to accommodate people with mobility issues, known as Americans with Disabilities Act (ADA) ramps or accommodation ramps, are commonly installed at public and private buildings, facilities, and parks. ADA ramps enable people with mobility issues, such as people who use wheelchairs, walkers, or other mobility aids, to access spaces that they could not access if using steps or stairs was required. Parents with strollers and people transporting goods, such as with wheeled carts, also benefit from ADA ramps.

Regulated accommodation ramps, such as ADA ramps, must be configured according to specific requirements. For example, ADA ramps must be at least 12 inches in length and have a slope not exceeding 1 inch of rise for every 12 inches in length. The strict requirements for ADA ramps mean that ADA ramps must be constructed with tight tolerances.

Forming ADA ramps with conventional methods that meet the tolerance requirements is challenging and time consuming. ADA ramps are often formed from concrete, and considerable skill and experience setting conventional concrete forms for ADA ramps is required to form compliant ADA ramps.

It would be desirable to have a more effective and simple system for making ADA ramps with concrete. More effective systems to create compliant ADA ramps from concrete would reduce the time and labor currently required for them. Reducing the time and labor required would reduce the costs and effort to install ADA ramps.

Thus, there exists a need for adjustable concrete forms that improve upon and advance the design of known concrete forms. Examples of new and useful adjustable concrete forms relevant to the needs existing in the field are discussed below.

SUMMARY

The present disclosure is directed to adjustable concrete forms including a landing form and a ramp form. The landing form includes jacks and landing brace members. The jacks rest on a support surface and are operable to selectively adjust their height.

The landing brace members are supported a selected and adjustable distance above the support surface by the jacks. The landing brace members are connected together to define a landing formwork configured to contain poured concrete in a desired landing shape.

The ramp form is pivotally coupled to the landing form and includes ramp brace members and couplers. The ramp brace members are pivotally coupled to the landing brace members and extend from the landing brace members towards a ramp start boundary. The ramp brace members define a ramp formwork configured to contain poured concrete in a desired ramp shape while the concrete sets.

The couplers are coupled to the ramp brace members proximate the ramp start boundary and are configured to selectively couple to a structure proximate the ramp start boundary. The slope of the landing formwork and the slope of the ramp formwork are adjustable by selectively adjusting the height at which the jacks support the landing brace members.

DETAILED DESCRIPTION

Figure 1:
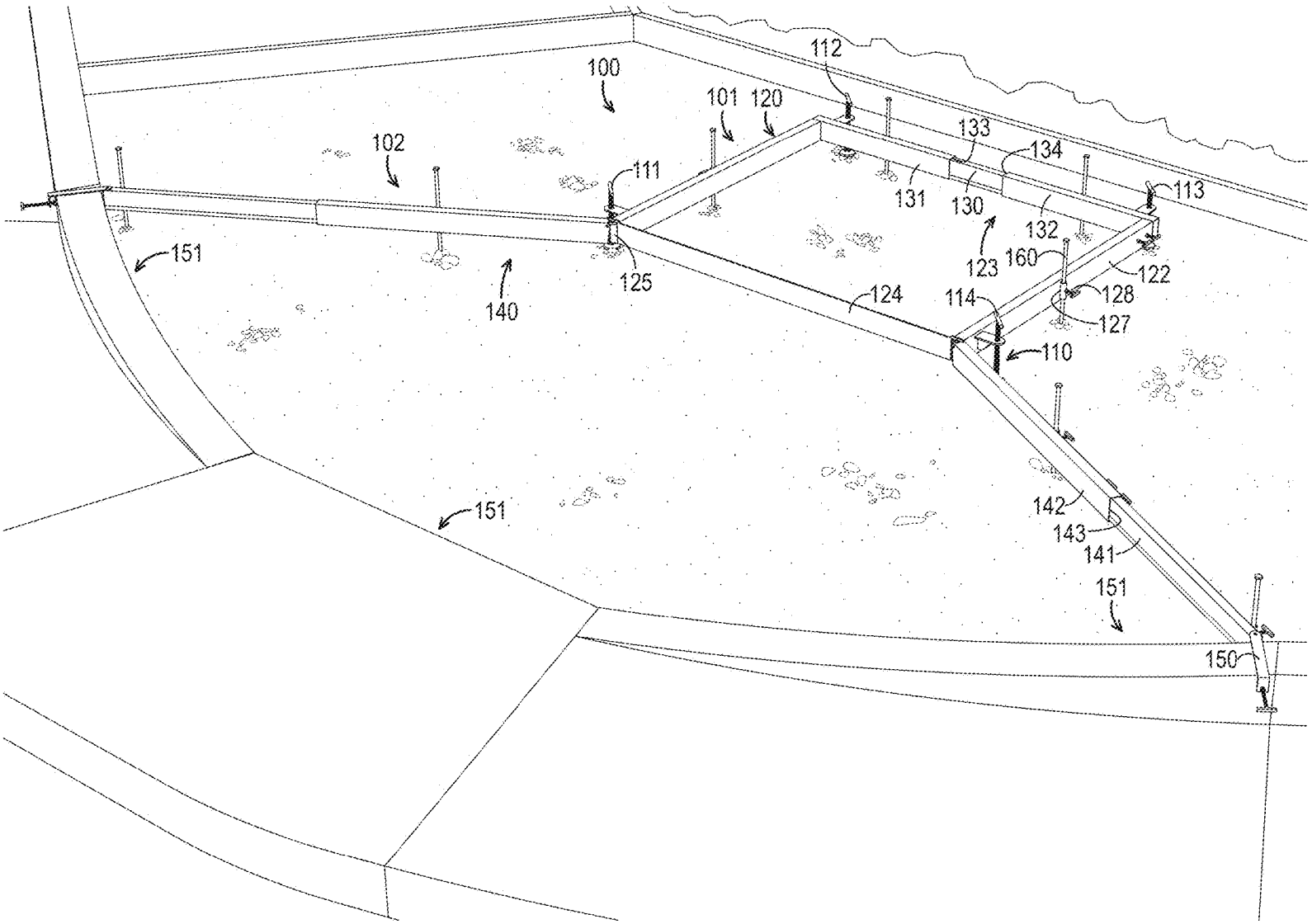
FIG. 1 is a perspective view of a first example of an adjustable concrete form.

The disclosed adjustable concrete forms will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various adjustable concrete forms are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Adjustable Concrete Forms

With reference to the figures, adjustable concrete forms will now be described. The adjustable concrete forms discussed herein function to define the shape and slope of concrete as it sets. Often, the adjustable concrete forms define the shape and slope of ADA ramps made from concrete.

The reader will appreciate from the figures and description below that the presently disclosed novel adjustable concrete forms address many of the shortcomings of conventional adjustable concrete forms. For example, the novel adjustable concrete forms enable conveniently and effectively building ADA ramps that meet applicable tolerance requirements. With the novel adjustable concrete forms, workers with less skill and experience can effectively form ADA ramps that meet the requirements than is possible using conventional techniques to form ADA ramps.

Desirably, the novel adjustable concrete forms provide an effective and simple system for making ADA ramps with concrete. The novel adjustable concrete forms reduce the time and labor currently required for building ADA ramps. The novel adjustable concrete forms reducing the time and labor required to install ADA ramps reduces the overall cost and effort to install ADA ramps.

Adjustable Concrete Form Embodiment One

With reference to FIGS. 1-8B, a first example of an adjustable concrete form, adjustable concrete form 100, will now be described. FIG. 9 depicts a second example of an adjustable concrete form, adjustable concrete form 200. Differences between adjustable concrete forms 100 and 200 are discussed below.

Adjustable concrete form 100 may be used to create concrete structures in a wide variety of shapes and sizes. A common application for adjustable concrete form 100 is to create ADA ramps. In particular, adjustable concrete form 100 may be used to build ADA ramps that meet applicable requirements, including slope, length, and height requirements.

The size of the adjustable concrete form varies in different examples. Some adjustable concrete form examples are larger than depicted in the figures while other examples are smaller. In general, the size of the adjustable concrete form will be selected to accommodate the size of the structure sought to be formed from concrete, such as an ADA ramp, while also balancing weight and transport convenience factors.

Adjustable concrete form 100 includes a landing form 101 and a ramp form 102. In some examples, the adjustable concrete form does not include one or more features included in adjustable concrete form 100. In other examples, the adjustable concrete form includes additional or alternative features. The components of adjustable concrete form 100 are discussed in the sections below.

Landing Form

Landing form 101 functions to define the shape and size of a landing formwork. The landing formwork corresponds to a landing of an ADA ramp formed from concrete. Concrete is poured into landing form 101, allowed to set into the desired shape of the landing with initial strength characteristics, and then allowed to cure to full strength in the desired landing shape.

The size and shape of the landing form may differ from the size and shape of landing form 101 depicted in the figures. Larger ADA ramp landings may require larger landing forms while smaller landing designs may allow for smaller landing forms.

As can be seen in FIGS. 1-8B, landing form 101 includes jacks 110 and landing brace members 120. In some examples, the landing form includes additional or alternative components. The components of landing form 101 are described in the sections below.

Jacks

Jacks 110 function to support brace members 120 from the ground or other support surface. In particular, jacks 110 enable supporting brace members 120 at selected heights above the ground. The slope of the landing formwork formed by landing form 101 and the slope of the ramp formwork formed by ramp form 102 are adjustable by selectively adjusting the height at which jacks 110 support landing brace members 120.

As shown in FIGS. 1-7, jacks 110 jacks rest on a support surface. FIGS. 1-7 demonstrate that multiple jacks 110 are spaced apart around a periphery of landing form 101.

With reference to FIG. 1, landing form 101 includes four jacks 110, namely a first jack 111, a second jack 112, a third jack 113, and a fourth jack 114. However, the number of jacks utilized in the landing form may vary in different examples. For instance, larger landing forms may include additional jacks. In certain examples, fewer than four jacks are utilized. The landing form may include as many jacks as necessary to achieve a desired level of stability and height adjustability.

As depicted in FIGS. 1-7, jacks 110 support brace members 120 above the ground around the periphery of landing form 101. With reference to FIG. 1, first jack 111 is coupled to a first brace member 121 proximate one of ramp brace members 140. Second jack 112 is coupled to a first cross member 123 proximate first brace member 121. Third jack 113 is coupled to first cross member 123 proximate second brace member 122. Fourth jack 114 is coupled to second brace member 122 proximate one of ramp brace members 140.

Figure 5:
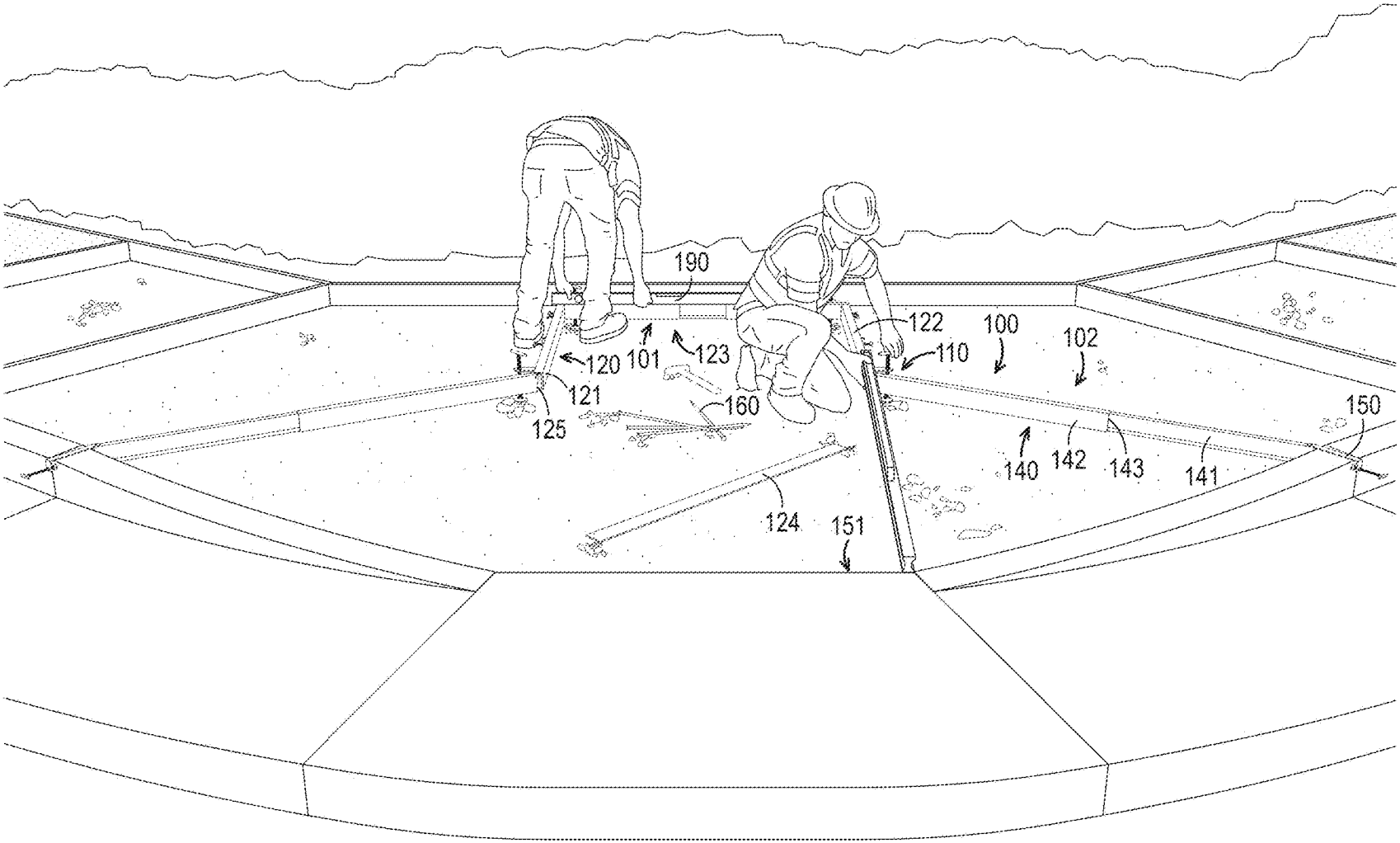
FIG. 5 is a front view of a slope of the landing form and a slope of the ramp form being adjusted by adjusting the heights above the ground that jacks support brace members of the adjustable concrete form shown in FIG. 1.

Jacks 110 are operable to selectively adjust their height. FIG. 5 depicts a user adjusting the height of a jack 110 by twisting a handle of jack 110. Jacks 110 are screw jacks, but other types of jacks and alternative mechanisms for adjusting the height of the jacks may be used in other examples.

Selectively adjusting the height of jacks 110 functions to selectively adjust the height above the ground of landing brace members 120 supported on jacks 110. Further, selectively adjusting the height of jacks 110 functions to selectively adjust the height above the ground of ramp brace members 140 coupled to landing brace members 120. By adjusting the height of landing brace members 120 and ramp brace members 140 above the ground, the slope of the landing formwork and the ramp formwork may be adjusted.

FIG. 5 depicts a user measuring the slope established by landing form 101 and ramp form 102 with a bubble level tool 190. FIG. 5 further depicts the user adjusting the height of a jack 110 to correspondingly adjust the height of landing brace members 120 and ramp brace members 140. The adjustment of jack 110 depicted in FIG. 5 ultimately adjusts the slope of the landing formwork and the ramp formwork that will be formed by landing form 101 and ramp form 102.

Landing Brace Members

Landing brace members 120 cooperate to define a landing formwork to establish a desired shape for a landing of an ADA ramp. Landing brace members 120 serve as form walls containing poured concrete as the concrete sets. In some examples, additional form walls are supported by landing brace members 120 and/or stakes 160 coupled landing brace members 120.

Figure 2:
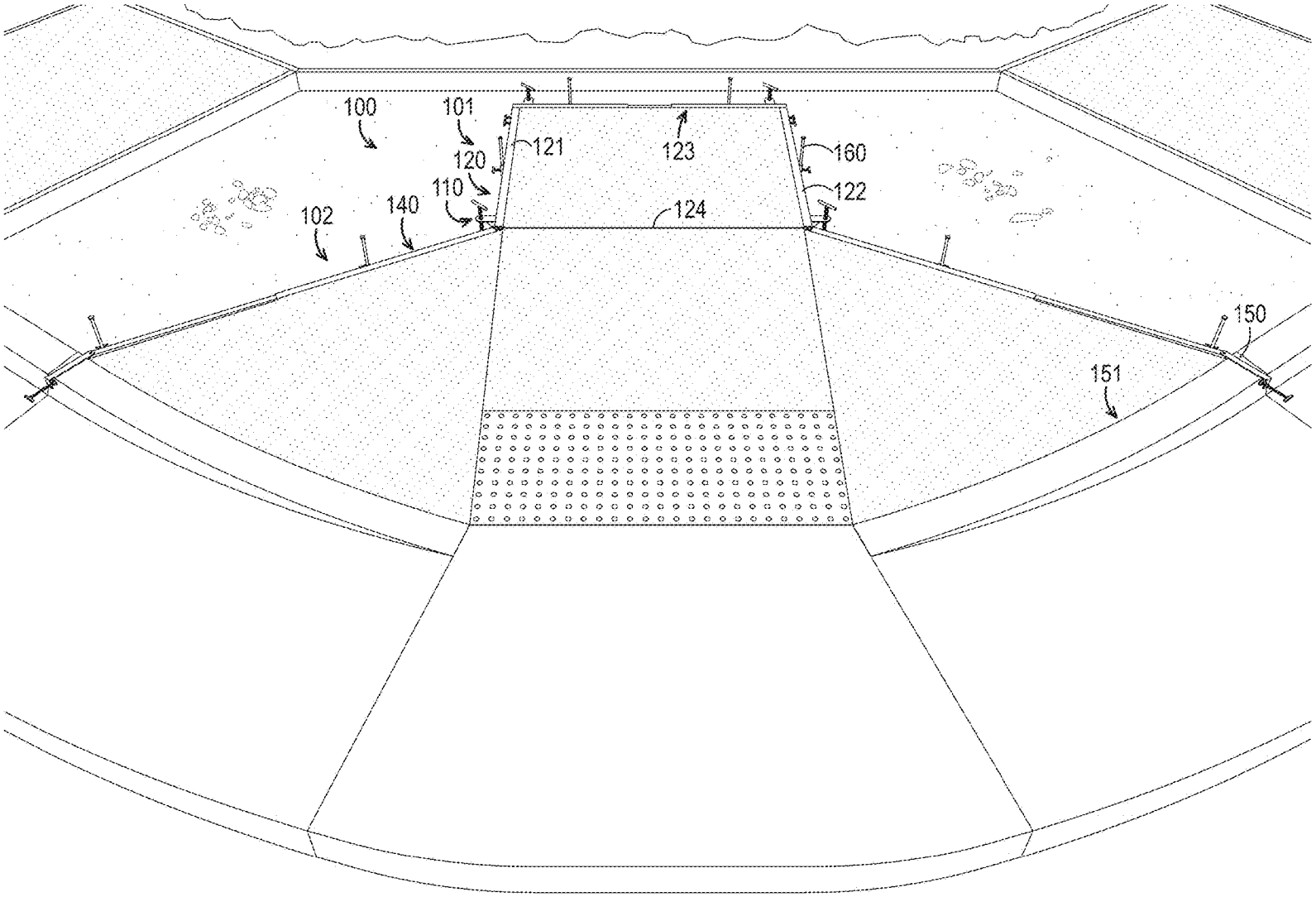
FIG. 2 is a perspective view of concrete setting within the adjustable concrete form shown in FIG. 1 and a tactile surface installed to define an accessibility ramp.
Figure 6:
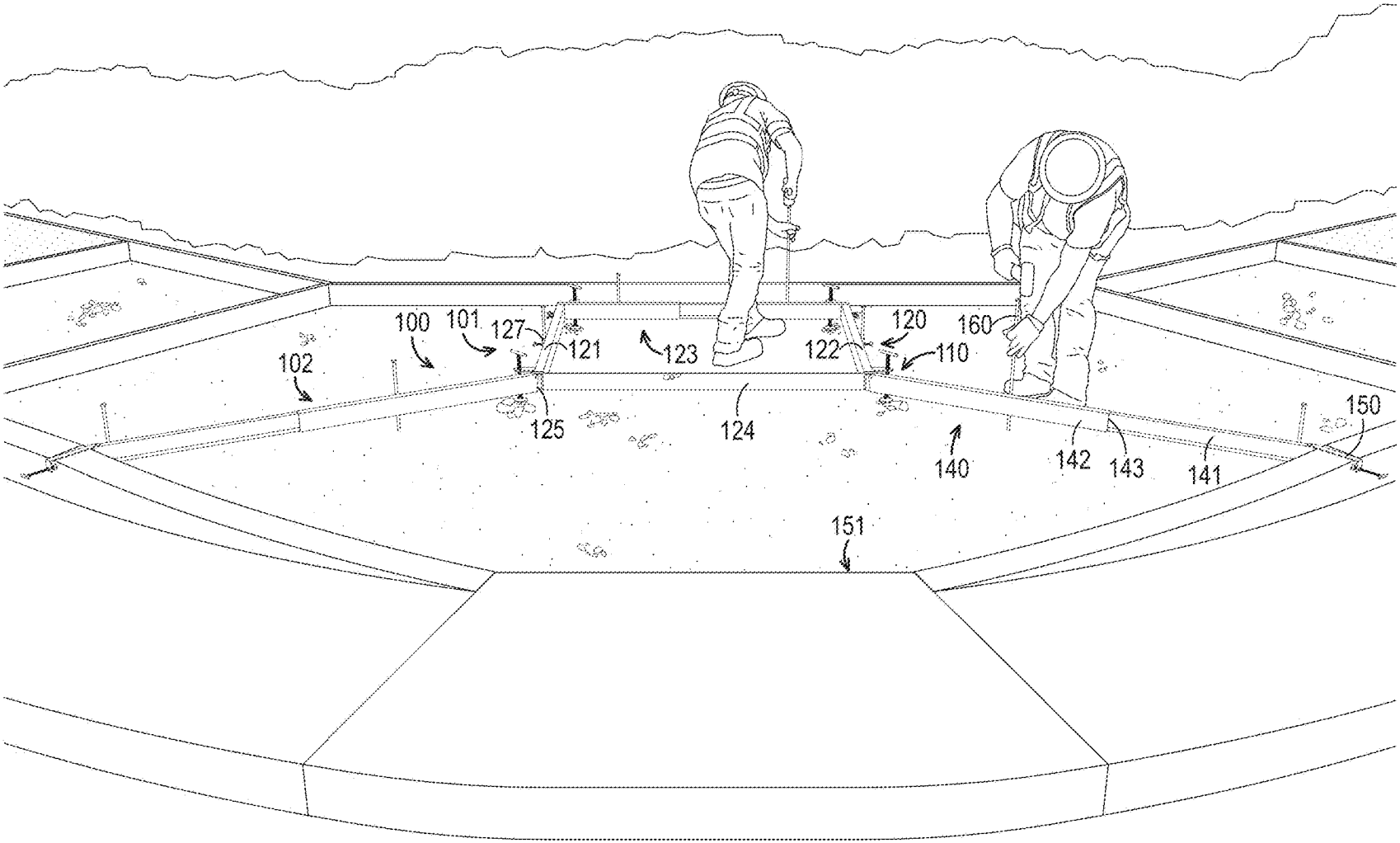
FIG. 6 is a front view of stakes being installed in the ground through stake pockets of the brace members.
Figure 7:
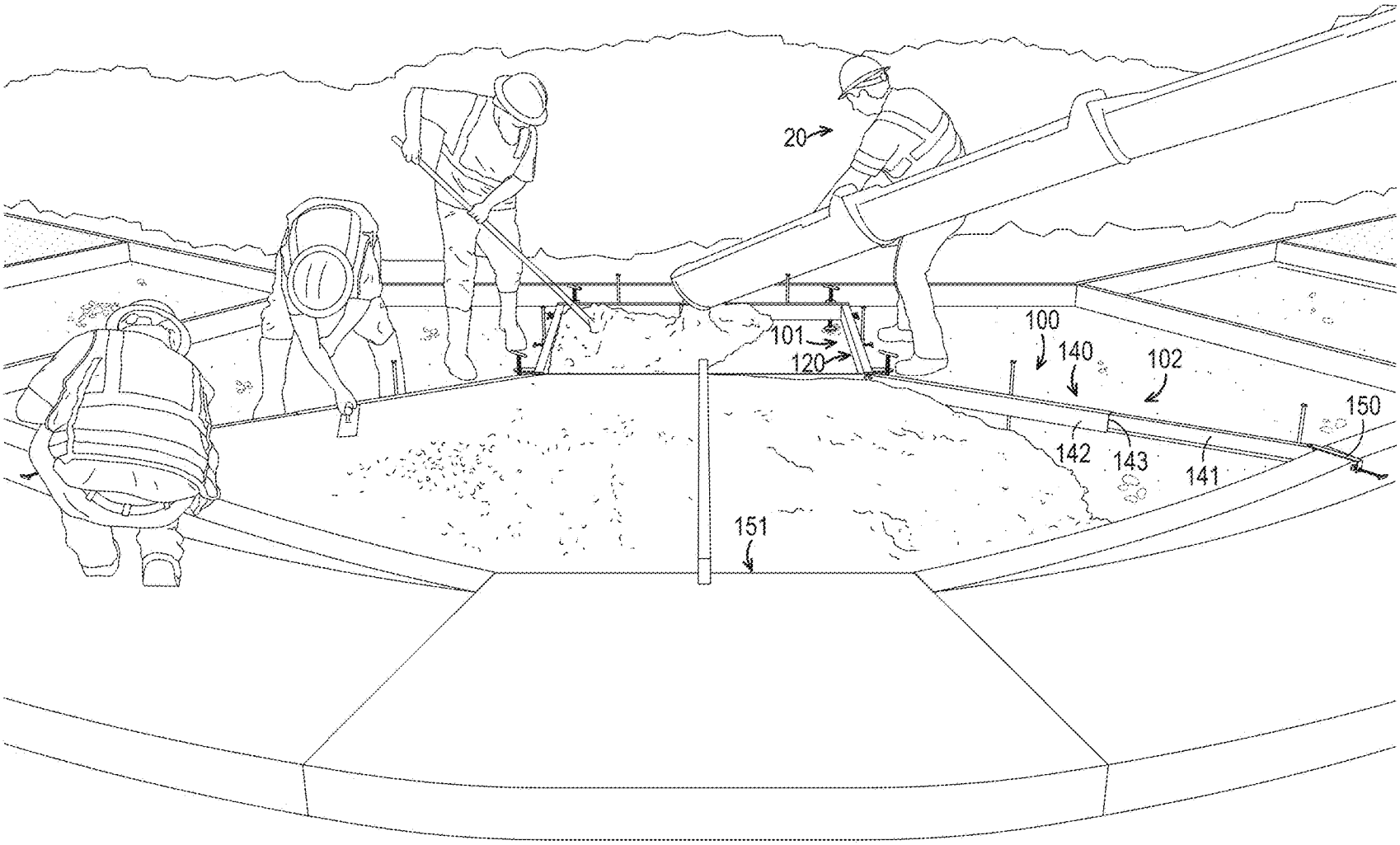
FIG. 7 is a front view of concrete being poured into the adjustable concrete form shown in FIG. 1.

FIGS. 6 and 7 demonstrate that landing brace members 120 connect together to define a landing formwork. The landing formwork establishes the size, shape, and slope of a landing resulting from pouring concrete into the landing formwork. In more detail, the landing formwork enables a landing with desired size, shape, and slope attributes to be formed when concrete is poured into the landing formwork like shown in FIG. 7, the top surface of the concrete is worked, and the concrete is allowed to set. FIG. 2 shows the landing formed by the landing formwork defined by landing brace members 120.

In the present example, as shown in FIGS. 1-7 landing brace members 120 include a first brace member 121, a second brace member 122, a first cross member 123, and a second cross member 124. As shown in FIGS. 1-7, landing brace members 120 form a rectangle when connected together. However, the landing brace members may form other shapes in other examples, including squares, parallelograms, and trapezoids. Landing forms with different numbers of landing brace members may form alternative shapes, such as triangles, pentagons, other regular polygons, or irregular shapes.

First brace member 121 is pivotally coupled to one of ramp brace members 140. Second brace member 122 is spaced from and parallel to first brace member 121. Second brace member 122 is pivotally coupled to one of ramp brace members 140.

First cross member 123 and second cross member 124 extend between first brace member 121 and second brace member 122 and are spaced from each other. First cross member 123 is distal ramp form 102 and second cross member 124 is proximate ramp form 102.

First cross member 123 is length adjustable, which enables the width of landing form 101 to be adjusted. In the present example, second cross member 124 has a fixed length, but can be configured to have an adjustable length in other examples.

With reference to FIG. 1, first cross member 123 includes a first outer cross member arm 131, a second cross member arm 132, and an inner cross member arm 130. Second outer cross member arm 132 is selectively spaced from first outer cross member arm 131. First outer cross member arm 131 defines a first cross member sleeve 133, and second outer cross member arm 132 defines a second cross member sleeve 134.

Inner cross member arm 130 is moveably disposed within the first cross member sleeve 133 and in second cross member sleeve 134. The effective length of first cross member 123 can be adjusted by sliding inner cross member arm 130 relative to first cross member sleeve 133 and second cross member sleeve 134. Adjusting the effective length of first cross member 123 adjusts the width of landing form 101.

With reference to FIG. 9, an alternative configuration of the first cross member is demonstrated with first cross member 223 in adjustable concrete form 200. Adjustable concrete form 200 includes a landing form 201 and a ramp form 202. First cross member 223 is configured similarly to first cross member 123 in certain respects, and this description will focus primarily on configuration differences.

First cross member 223 includes a first outer cross member arm 231, a second cross member arm 232, an inner cross member arm 230, and cross member adjustment shafts 235. Second outer cross member arm 232 is selectively spaced from first outer cross member arm 231. First outer cross member arm 231 defines a first cross member sleeve 233 and cross member ports 237. Second outer cross member arm 232 defines a second cross member sleeve 234.

First cross member adjustment shafts 235 are configured to extend through cross member ports 237. Cross member ports 237 and cross member adjustment shafts 235 are complementarily threaded.

In more detail, cross member adjustment shafts 235 may selectively extend through cross member ports 237 sufficient to press against inner cross member arm 230 disposed within first cross member sleeve 233. Cross member adjustment shafts 235 pressing against inner cross member arm 230 within cross member sleeve 233 fixes the position of inner cross member arm 230 relative to first outer cross member arm 231. In this manner, the effective length of first cross member 223 may be fixedly adjusted.

In some examples, the first cross member includes a single sleeve and shaft for fixing the effective length of the first cross member. In certain examples, the second outer cross member arm includes an adjustment sleeve and shaft in addition or alternatively to the adjustment sleeve and shaft in the first outer cross member arm.

Returning attention to FIGS. 1-7, landing brace members 120 are supported on jacks 110. In particular, landing brace members 120 are supported by jacks 110 a selected and adjustable distance above the support surface on which jacks 110 rest. The height at which landing brace members 120 are supported on jacks 110 establishes the slope of a landing formed from the landing formwork defined by landing brace members 120.

As shown in FIG. 1, first brace member 121 is supported on first jack 111 proximate one of ramp brace members 140. First cross member 123 is supported on second jack 112 proximate first brace member 121 and supported on third jack 113 proximate second brace member 122. Second brace member 122 is supported on fourth jack 114 proximate another ramp brace member 140.

Figure 8A:
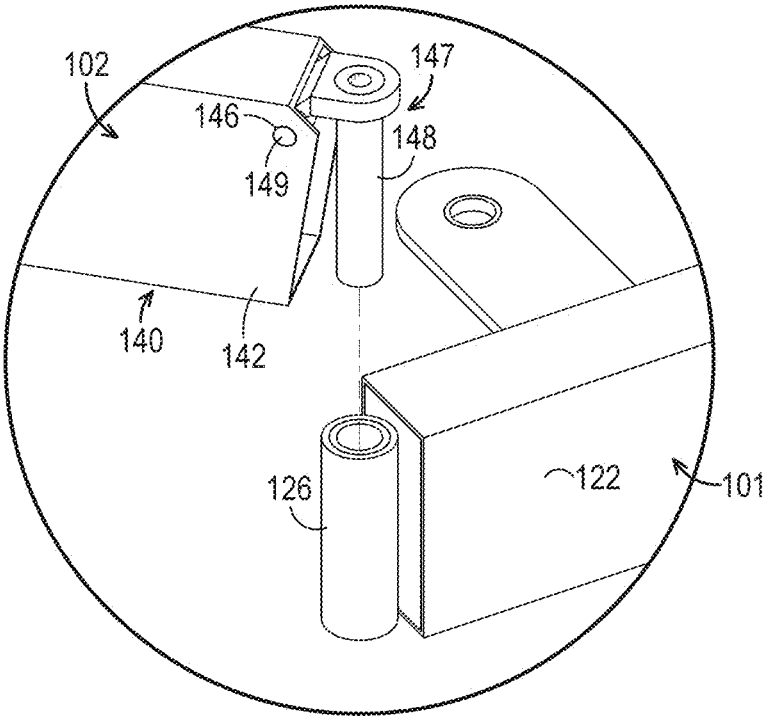
FIG. 8A is a perspective view of a pivot assembly between brace members of the landing form and the ramp form enabling the ramp members to pivot horizontally and vertically, the pivot assembly depicted with a vertical pivot shaft spaced from a vertical pivot bearing.
Figure 8B:
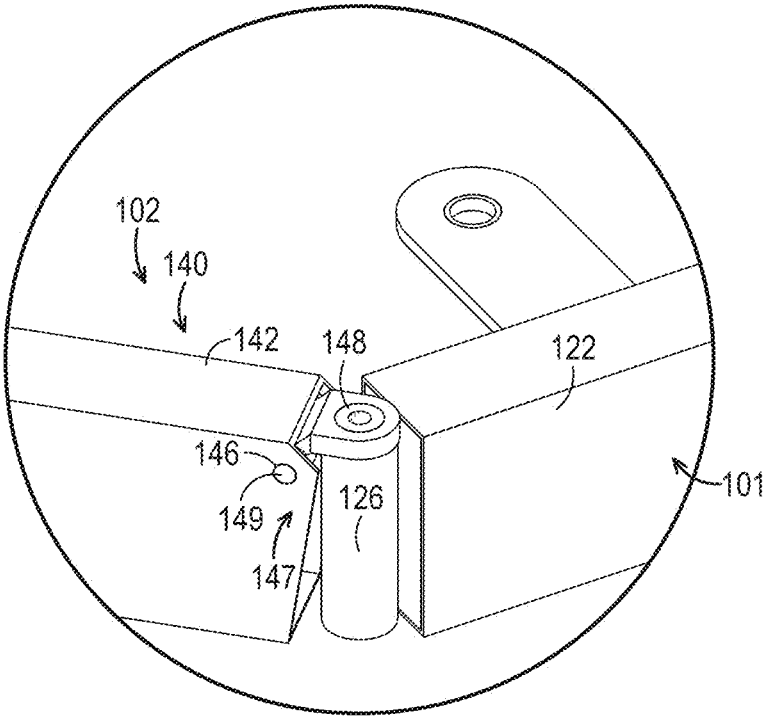
FIG. 8B is a perspective view of the pivot assembly shown in FIG. 8A with the vertical pivot shaft inserted into the vertical pivot bearing.
Figure 9:
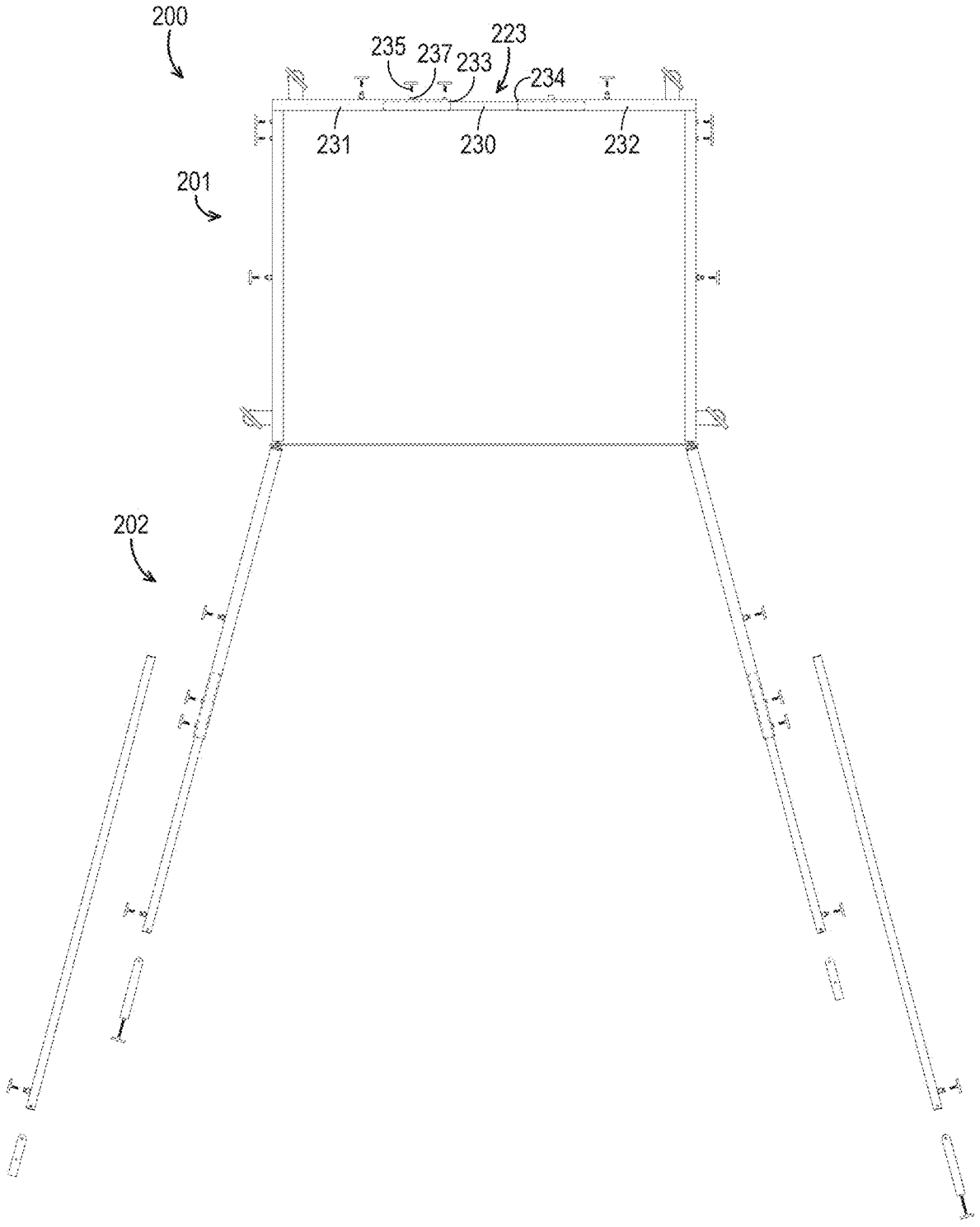
FIG. 9 is a top view of a second example of an adjustable concrete form with a length adjustable landing form cross member and length adjustable ramp members.

As shown in FIGS. 8A and 8B, second brace member 122 includes a vertical bearing 126 proximate one of ramp brace members 140. FIGS. 1 and 3-6 show that first brace member 121 also includes a vertical bearing 125 proximate one of ramp brace members 140.

Vertical bearings 125 and 126 facilitate pivotally coupling brace members 121 and 122 to ramp brace members 140. As highlighted in FIGS. 8A and 8B, vertical bearing 126 receives a vertical pivot shaft 148 of a pivot assembly 147 of one of ramp brace members 140. Vertical pivot shaft 148 rotates within vertical bearing 126 to enable ramp brace member 140 to pivot horizontally relative to second brace member 122.

With reference to FIG. 1, landing brace members 120 include pockets 127. Pockets 127 are coupled to the main bodies of landing brace members 120. Pockets 127 are disposed on the main bodies of landing brace members 120 on outer sides of the landing formwork defined by landing brace members 120.

As shown in FIGS. 1, 2, 6, and 7, pockets 127 are configured to receive and couple to stakes 160. As depicted in FIG. 6, stakes 160 are passed through pockets 127 and then driven into the ground. Stakes 160 laterally support landing brace members 120 against the forces of concrete pressing against landing brace members 120 in the landing formwork.

FIG. 1 shows that landing brace members 120 include set screws 128 for coupling pockets 127 to stakes 160. Pockets 127 define set screw openings that receive set screws 128. Set screws 128 may be selectively extended through the set screw openings to engage stakes 160 disposed within pockets 127 after stakes 160 are driven into the ground. Set screws 128 engaging stakes 160 within pockets 127 couples pockets 127 to stakes 160.

Ramp Form

Ramp form 102 serves to define a ramp formwork configured to contain poured concrete in a desired ramp shape while the concrete sets. Ramp form 102 also functions to selectively couple adjustable concrete form 100 to a structure, such as a curb.

Ramp form 102 is pivotally coupled to landing form 101. The pivotal coupling enables the width of the ramp formwork defined by ramp form 102 to be adjusted.

As shown in FIGS. 1 and 2, ramp form 102 extends from landing brace members 120 towards a ramp start boundary 151. Ramp start boundary 151 is a low point of the ramp formed by the ramp formwork. In the example shown in FIGS. 1, 2, and 4-7, ramp start boundary 151 is proximate a sidewalk and a curb.

In the example shown in FIGS. 1-7, ramp form 102 includes ramp brace members 140 and couplers 150. The components of ramp form 102 are discussed in the sections below.

Ramp Brace Members

Ramp brace members 140 define the ramp formwork of ramp form 102. The ramp formwork defined by ramp brace members 140 is configured to contain poured concrete in a desired ramp shape while the concrete sets. Ramp brace members 140 cooperate with clamps 150 to couple adjustable concrete form 100 to a structure, such as a curb as shown in FIGS. 1, 2, and 4-7.

As shown in FIGS. 1, 2, and 4-7, ramp brace members 140 extend from landing brace members 120 towards ramp start boundary 151. Ramp brace members 140 are pivotally coupled to landing brace members 120 distal ramp start boundary 151. Proximate ramp start boundary 151, ramp brace members 140 are coupled to couplers 150.

Ramp brace members 140 are length adjustable, but some examples utilize fixed length ramp brace members. Ramp brace members 140 being length adjustable enables ramp form 102 to define ramp formworks yielding different length ramps. Ramp brace members 140 being length adjustable also enables them to cooperate with jacks 110 to adjust the slope of the ramp formwork.

As shown in FIGS. 1-7, ramp brace members 140 each include an outer ramp arm 142 and an inner ramp arm 141. Outer ramp arm 142 defines a ramp sleeve 143. Inner ramp arm 141 is moveably disposed within ramp sleeve 143 of outer ramp arm 142. Inner ramp arm 141 couples to coupler 150 on an end of inner ramp arm 141 distal outer ramp arm 142.

Figure 3:
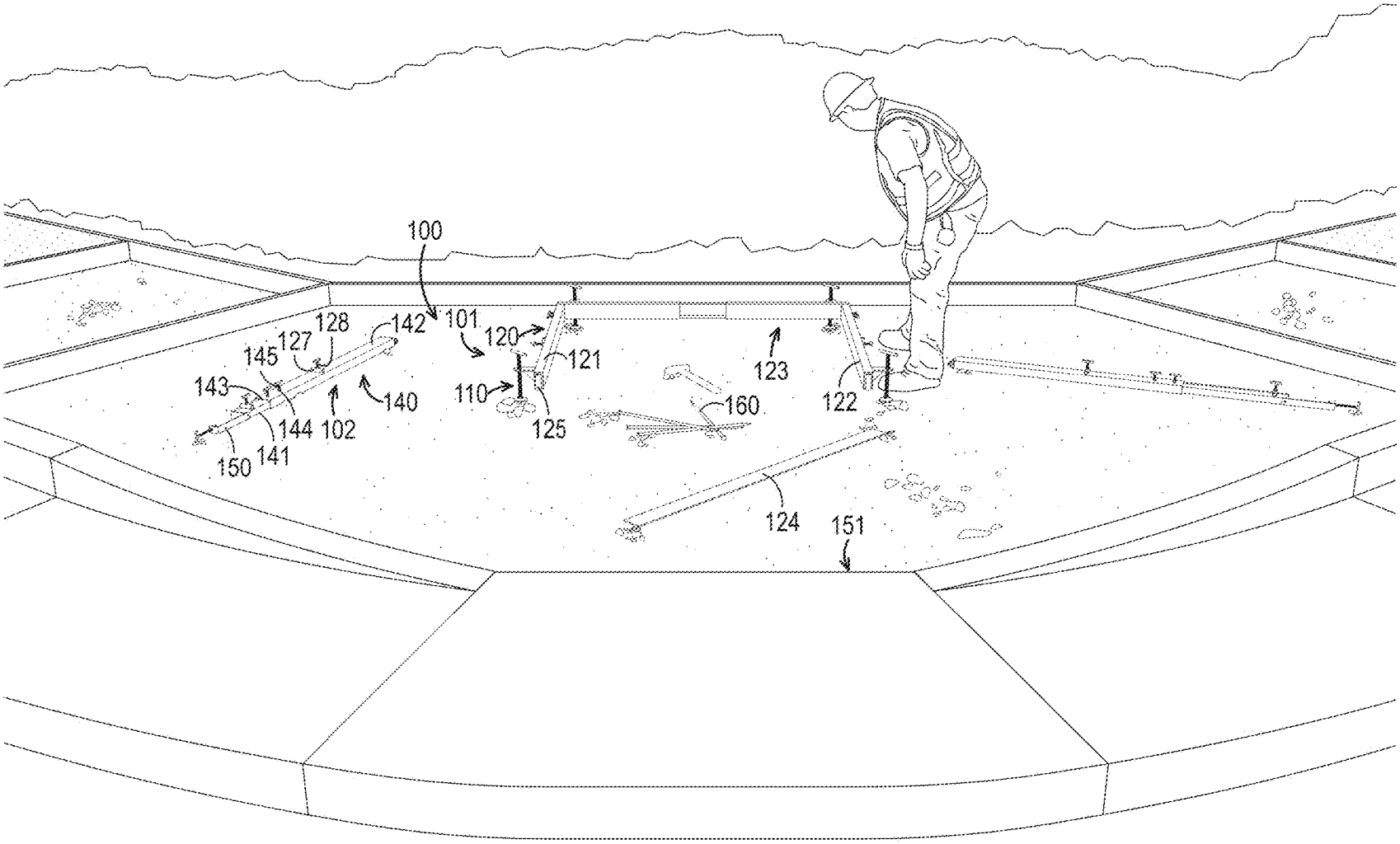
FIG. 3 is a front view of a landing form of the adjustable concrete form shown in FIG. 1 being assembled.
Figure 4:
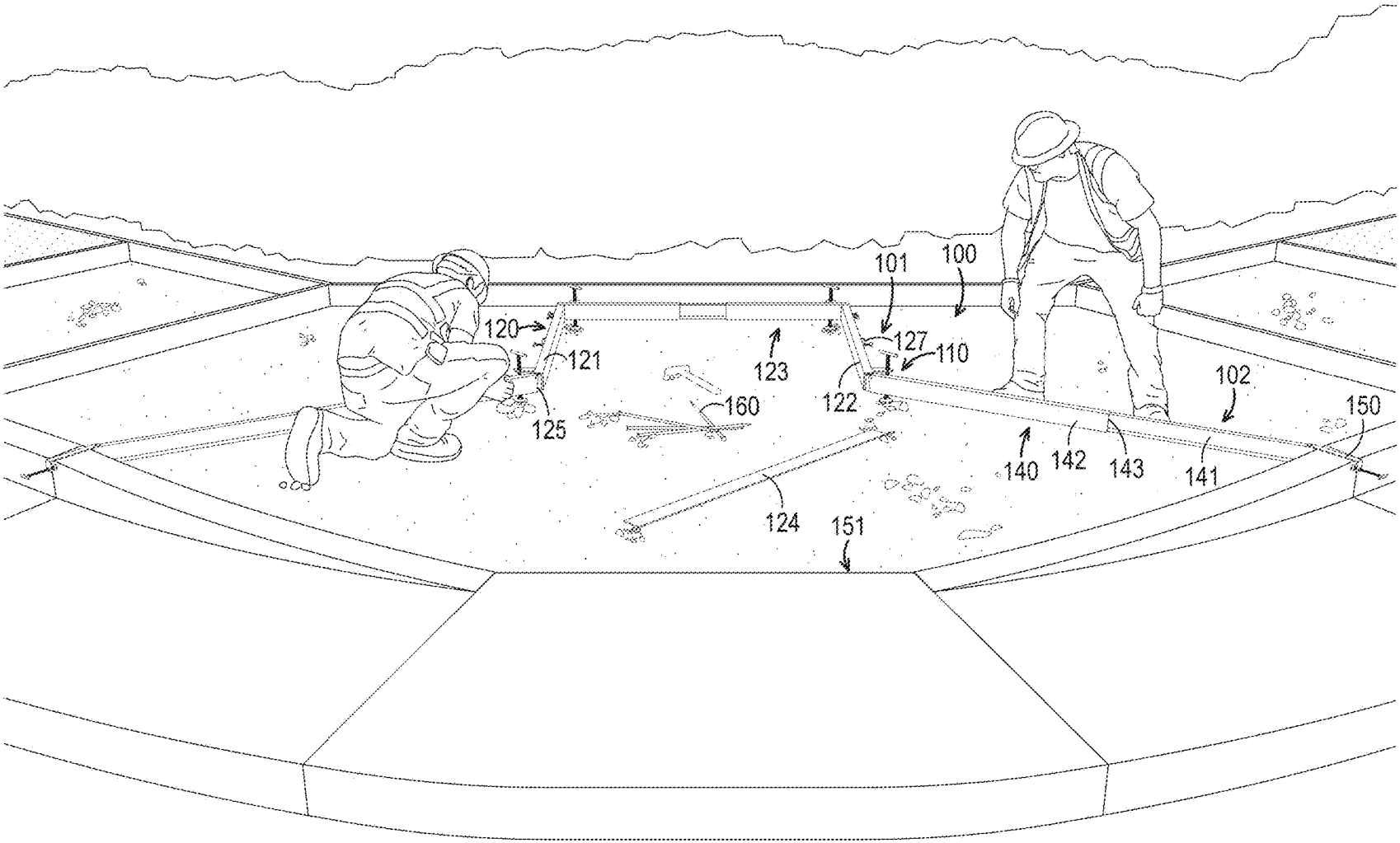
FIG. 4 is a front view of a ramp form of the adjustable concrete form shown in FIG. 1 being assembled.

With reference to FIG. 3 depicting an unattached ramp brace member 140 resting on its inner face to the left of landing form 101, the reader can see that outer ramp arm 142 defines ramp arm ports 144. Further visible in FIG. 3 is that ramp brace members 140 include ramp adjustment shafts 145. Ramp arm ports 144 and ramp adjustment shafts 145 are complementarily threaded.

Ramp adjustment shafts 145 are configured to extend through ramp arm ports 144 and to press against inner ramp arm 141 disposed within ramp sleeve 143. Ramp adjustment shafts 145 pressing against inner ramp arm 141 within ramp sleeve 143 fixes the position of inner ramp arm 141 relative to outer ramp arm 142. Fixing the position of inner ramp arm 141 relative to outer ramp arm 142 fixes the adjusted effective length of ramp brace member 140.

FIGS. 1, 2, 6, and 7 demonstrate that ramp brace members 140 include pockets 127 and set screws 128 in the same manner as described above with regard to landing brace members 120. Pockets 127 are disposed on the main bodies of ramp brace members 140 on outer sides of the ramp formwork.

As depicted in FIG. 6, stakes 160 passing through pockets 127 included on ramp brace members 140 laterally support ramp brace members 140 against the forces of concrete pressing against ramp brace members 140 in the ramp formwork. Set screws 128 couple stakes 160 to pockets 127 of ramp brace members 140.

With reference to FIGS. 8A and 8B, the reader can see that ramp brace members 140 include pivot assemblies 147. Pivot assemblies 147 enable ramp brace members 140 to pivot horizontally and vertically relative to landing form 101. Pivot assemblies 147 are pivotally connected to both outer ramp arms 142 and landing brace members 121 and 122.

As shown in FIGS. 8A and 8B, pivot assembly 147 includes a vertical pivot shaft 148 and a horizontal pivot shaft 149. FIGS. 8A and 8B demonstrate that vertical pivot shaft 148 inserts into and is moveable within vertical bearing 126 of second landing brace member 122. Vertical bearing 126 and vertical pivot shaft 148 cooperate to enable the ramp brace member 140 to pivot horizontally.

As shown in FIGS. 8A and 8B, horizontal pivot shaft 149 is movably disposed within a horizontal bearing 146 defined in outer ramp arm member 142. Horizontal bearing 146 and horizontal pivot shaft 149 cooperate to enable ramp brace member 140 to pivot vertically.

Couplers

Couplers 150 enable ramp form 102 to selectively couple to a structure proximate the ramp start boundary 151. In the example shown in FIGS. 1-7, the structure to which couplers 150 attach are curbs, but couplers 150 may couple to a wide variety of structures. For example, the couplers may attach to walls, brackets, fences, posts, and spikes as applicable for a given job.

As shown in FIGS. 1-7, couplers 150 are coupled to ramp brace members 140 proximate ramp start boundary 151. In particular, couplers 150 are coupled to inner ramp arms 141 of ramp brace members 140. In some examples, the couplers are positioned in additional or alternative positions, such as at medial positions of the ramp brace members and/or proximate the landing form.

The example shown in FIGS. 1-7 includes two couplers 150, but additional or fewer couplers may be included in other examples. Some ramp form examples do not includes couplers.

As depicted in FIGS. 1-7, couplers 150 are clamps. However, other types of couplers are contemplated, such as hooks, loops, mechanical fasteners, and hook-and-loop fasteners. The couplers may be any currently known or later developed member suitable for linking the ramp form to a structure.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. An adjustable concrete form, comprising:
a landing form including:
jacks resting on a support surface and operable to selectively adjust the height of the jacks; and
landing brace members supported a selected and adjustable distance above the support surface by the jacks and connected together to define a landing formwork configured to contain poured concrete in a desired landing shape while the concrete sets;
a ramp form pivotally coupled to the landing form, the ramp form including:
ramp brace members pivotally coupled to the landing brace members and extending from the landing brace members towards a ramp start boundary, the ramp brace members defining a ramp formwork configured to contain poured concrete in a desired ramp shape while the concrete sets; and
couplers coupled to the ramp brace members proximate the ramp start boundary and configured to selectively couple to a structure proximate the ramp start boundary;
wherein the slope of the landing formwork and the slope of the ramp formwork are adjustable by selectively adjusting the height at which the jacks support the landing brace members;
the landing brace members include vertical bearings proximate the ramp brace members;
the ramp brace members include pivot assemblies;
the pivot assemblies include vertical pivot shafts moveably disposed within the vertical bearings;
the vertical bearings and the vertical pivot shafts cooperate to enable the ramp brace members to pivot horizontally;
the ramp brace members include outer ramp arm members;
the pivot assemblies are pivotally connected to the outer ramp arm members;
the outer ramp arm members include horizontal bearings;
the pivot assemblies include horizontal pivot shafts moveably disposed within the horizontal bearings; and
the horizontal bearings and the horizontal pivot shafts cooperate to enable the ramp members to pivot vertically.

2. The adjustable concrete form of claim 1, wherein the ramp brace members are length adjustable.

3. The adjustable concrete form of claim 2, wherein the ramp brace members each include:
an outer ramp arm defining a ramp sleeve; and
an inner ramp arm moveably disposed within the ramp sleeve of the outer ramp arm.

4. The adjustable concrete form of claim 3, wherein:
the outer ramp arm defines a ramp arm port; and
the ramp brace members include a ramp adjustment shaft configured to extend through the ramp arm port and to press against the inner ramp arm disposed within the ramp sleeve to fix the position of the inner ramp arm relative to the outer ramp arm.

5. The adjustable concrete form of claim 4, wherein the ramp arm port and the ramp adjustment shaft are complementarily threaded.

6. An adjustable concrete form, comprising:
a landing form including:
jacks resting on a support surface and operable to selectively adjust the height of the jacks; and
landing brace members supported a selected and adjustable distance above the support surface by the jacks and connected together to define a landing formwork configured to contain poured concrete in a desired landing shape while the concrete sets;
a ramp form pivotally coupled to the landing form, the ramp form including:
ramp brace members pivotally coupled to the landing brace members and extending from the landing brace members towards a ramp start boundary, the ramp brace members defining a ramp formwork configured to contain poured concrete in a desired ramp shape while the concrete sets; and
couplers coupled to the ramp brace members proximate the ramp start boundary and configured to selectively couple to a structure proximate the ramp start boundary;
wherein:
the ramp brace members are length adjustable;
the ramp brace members each include:
an outer ramp arm defining a ramp sleeve; and
an inner ramp arm moveably disposed within the ramp sleeve of the outer ramp arm;
the slope of the landing formwork and the slope of the ramp formwork are adjustable by selectively adjusting the height at which the jacks support the landing brace members; and
the couplers are coupled to the inner ramp arms of the ramp brace members.

7. The adjustable concrete form of claim 1, wherein the couplers are clamps.

8. The adjustable concrete form of claim 1, wherein the jacks are screw jacks.

9. The adjustable concrete form of claim 1, wherein the landing brace members include pockets configured to receive and couple to stakes.

10. The adjustable concrete form of claim 9, wherein:

the pockets define a set screw opening; and the landing brace members include set screws that selectively extend through the set screw openings to engage stakes disposed within the pockets.

11. The adjustable concrete form of claim 10, wherein the ramp brace members also include the pockets and the set screws.

12. The adjustable concrete form of claim 1, wherein the landing brace members include:

a first brace member pivotally coupled to a first ramp brace member;

a second brace member spaced from and parallel to the first brace member, the second brace member pivotally coupled to a second ramp brace member; and a cross member extending between the first brace member and the second brace member distal the ramp brace members.

13. An adjustable concrete form, comprising:

a landing form including:

jacks resting on a support surface and operable to selectively adjust the height of the jacks; and landing brace members supported a selected and adjustable distance above the support surface by the jacks and connected together to define a landing formwork configured to contain poured concrete in a desired landing shape while the concrete sets;

a ramp form pivotally coupled to the landing form, the ramp form including:

ramp brace members pivotally coupled to the landing brace members and extending from the landing brace members towards a ramp start boundary, the ramp brace members defining a ramp formwork configured to contain poured concrete in a desired ramp shape while the concrete sets; and couplers coupled to the ramp brace members proximate the ramp start boundary and configured to selectively couple to a structure proximate the ramp start boundary;

wherein:

the landing brace members include:

a first brace member pivotally coupled to a first ramp brace member;

a second brace member spaced from and parallel to the first brace member, the second brace member pivotally coupled to a second ramp brace member; and a cross member extending between the first brace member and the second brace member distal the ramp brace members; and the jacks include:

a first jack coupled to the first brace member proximate the first ramp brace member;

a second jack coupled to the cross member proximate the first brace member;

a third jack coupled to the cross member proximate the second brace member; and a fourth jack coupled to the second brace member proximate the second ramp brace member.

14. The adjustable concrete form of claim 12, wherein the cross member is length adjustable.

15. An adjustable concrete form, comprising:

a landing form including:

jacks resting on a support surface and operable to selectively adjust the height of the jacks; and landing brace members supported a selected and adjustable distance above the support surface by the jacks and connected together to define a landing formwork configured to contain poured concrete in a desired landing shape while the concrete sets;

a ramp form pivotally coupled to the landing form, the ramp form including:

ramp brace members pivotally coupled to the landing brace members and extending from the landing brace members towards a ramp start boundary, the ramp brace members defining a ramp formwork configured to contain poured concrete in a desired ramp shape while the concrete sets; and couplers coupled to the ramp brace members proximate the ramp start boundary and configured to selectively couple to a structure proximate the ramp start boundary;

wherein:

the landing brace members include:

a first brace member pivotally coupled to a first ramp brace member;

a second brace member spaced from and parallel to the first brace member, the second brace member pivotally coupled to a second ramp brace member; and a cross member extending between the first brace member and the second brace member distal the ramp brace members; and the cross member includes:

a first outer cross member arm defining a first cross member sleeve;

a second outer cross member arm selectively spaced from the first outer cross member arm and defining a second cross member sleeve; and an inner cross member arm moveably disposed within the first cross member sleeve and the second cross member sleeve.

16. The adjustable concrete form of claim 15, wherein:

the first outer cross member arm defines a cross member port; and the cross member includes a cross member adjustment shaft configured to extend through the cross member port and to press against the inner cross member arm disposed within the first cross member sleeve to fix the position of the inner cross member arm relative to the first outer cross member arm.

17. The adjustable concrete form of claim 16, wherein the cross member port and the cross member adjustment shaft are complementarily threaded.

* * * * *